US010739097B1

(12) United States Patent
Gaines et al.

(10) Patent No.: US 10,739,097 B1
(45) Date of Patent: Aug. 11, 2020

(54) THERMAL RESPIRATING SOUND SUPPRESSOR

(71) Applicants: Lance L. Gaines, Elkins, AR (US); Adam Murray, Fayetteville, AR (US); Bobby Stephenson, Pettigrew, AR (US)

(72) Inventors: Lance L. Gaines, Elkins, AR (US); Adam Murray, Fayetteville, AR (US); Bobby Stephenson, Pettigrew, AR (US)

( * ) Notice: Subject to any disclaimer, the term of this patent is extended or adjusted under 35 U.S.C. 154(b) by 0 days.

(21) Appl. No.: 16/704,685

(22) Filed: Dec. 5, 2019

Related U.S. Application Data

(63) Continuation-in-part of application No. 16/102,093, filed on Aug. 13, 2018.

(60) Provisional application No. 62/544,307, filed on Aug. 11, 2017.

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30; F41A 21/325
See application file for complete search history.

(56) References Cited

U.S. PATENT DOCUMENTS

| | | | | |
|---|---|---|---|---|
| 1,017,003 | A | 2/1912 | Kenney | |
| 1,111,202 | A | 9/1914 | Westfall | |
| 1,525,846 | A | 2/1925 | Wurtzebach | |
| 2,539,275 | A | 1/1951 | Sahlin et al. | |
| 3,677,132 | A | 7/1972 | Plenge | 89/14 |
| 3,713,362 | A | 1/1973 | Charron | 89/14 |
| 3,783,738 | A | 1/1974 | Pelat | 89/44 |
| 3,952,629 | A | 4/1976 | Boiccarossa et al. | 89/14 |
| 4,210,060 | A | 7/1980 | Donovan | 89/192 |
| 5,036,747 | A | 8/1991 | McClain, III | 89/14.3 |
| 5,123,329 | A | 6/1992 | Irwin | 89/161 |
| 5,655,632 | A | 8/1997 | Valembois | 188/136 |
| 6,176,032 | B1 | 1/2001 | Cohen et al. | 42/96 |
| 7,380,487 | B2 | 6/2008 | Mantras | 89/42.01 |
| 7,588,122 | B2 | 9/2009 | Brittingham | 181/223 |
| 7,905,171 | B1 | 3/2011 | Brittingham | 89/36.08 |
| 7,997,020 | B2 | 8/2011 | Brixius | 42/90 |
| 8,162,100 | B2 | 4/2012 | Shults et al. | 181/223 |
| 8,196,701 | B1 | 6/2012 | Oliver | 181/223 |
| 8,245,618 | B2 | 8/2012 | Emde | 89/14.1 |
| 8,272,306 | B1 | 9/2012 | Smith | 89/14.4 |
| 8,387,299 | B1 | 3/2013 | Brittingham et al. | 42/90 |
| 8,424,441 | B2 | 4/2013 | Brittingham et al. | 89/14.4 |
| 8,561,757 | B1 | 10/2013 | Edsall | 181/223 |
| 8,857,306 | B1 | 10/2014 | Edsall | 89/14.05 |
| 8,939,057 | B1 | 1/2015 | Edsall | 89/14.05 |
| 8,967,325 | B1 | 3/2015 | Cronhelm | 181/223 |
| 9,038,771 | B1 | 5/2015 | Mueller | 181/223 |
| 9,115,949 | B1 | 8/2015 | Morrison | 181/223 |

(Continued)

*Primary Examiner* — Michelle Clement
(74) *Attorney, Agent, or Firm* — Keisling & Pieper PLC; David B. Pieper

(57) ABSTRACT

A mechanically vented noise suppressor for a firearm using a piston and baffles to capture above atmospheric gas pressure. The device uses a series of baffles in combination with a piston contained between two springs inside a tube. This piston moves to absorb and release high pressure gas from the barrel bore and draw in outside air to cool the suppressor components.

8 Claims, 14 Drawing Sheets

(56) References Cited

U.S. PATENT DOCUMENTS

| | | | | |
|---|---|---|---|---|
| 9,115,950 | B2 | 8/2015 | Bethlenfalvy | 181/223 |
| 9,322,607 | B1 * | 4/2016 | Lau | F41A 21/30 |
| 9,347,727 | B1 | 5/2016 | Cler | 89/14.4 |
| 9,400,151 | B1 | 7/2016 | Edsall | |
| 9,500,427 | B1 | 11/2016 | Larue | 89/14.4 |
| 9,671,188 | B2 | 6/2017 | Sellars | |
| 9,709,354 | B2 | 7/2017 | Larue | 89/14.4 |
| 9,714,805 | B1 | 7/2017 | Lau | 89/14.3 |
| 10,024,617 | B1 | 7/2018 | Moore et al. | 89/14.2 |
| 10,048,033 | B1 | 8/2018 | Lee | 89/14.4 |
| 10,082,354 | B1 | 9/2018 | Lee | 89/14.2 |
| 10,107,581 | B2 | 10/2018 | Garst et al. | 89/14.2 |
| 10,184,745 | B1 * | 1/2019 | Fulton | F41A 21/30 |
| 2003/0010187 | A1 | 1/2003 | Muirhead | 89/14.1 |
| 2003/0145718 | A1 | 8/2003 | Hausken et al. | 89/14.4 |
| 2006/0048637 | A1 | 3/2006 | Dimitrios | 89/14.3 |
| 2007/0095198 | A1 | 5/2007 | Dater et al. | 89/14.2 |
| 2009/0050403 | A1 | 2/2009 | Brittingham | 181/223 |
| 2009/0133570 | A1 | 5/2009 | Pfersmann et al. | 89/14.3 |
| 2011/0036233 | A1 | 2/2011 | DeGroat | 89/14.4 |
| 2011/0067950 | A1 * | 3/2011 | Shults | F41A 21/30<br>181/223 |
| 2011/0088540 | A1 * | 4/2011 | Brittingham | F41A 21/26<br>89/14.5 |
| 2011/0252952 | A1 | 10/2011 | McNeill et al. | 89/14.3 |
| 2012/0279381 | A1 | 11/2012 | Landolt | 89/14.4 |
| 2013/0319790 | A1 | 12/2013 | Bladen | 181/223 |
| 2014/0020976 | A1 | 1/2014 | Shults | 181/223 |
| 2014/0059909 | A1 | 3/2014 | Caudle | 42/1.06 |
| 2014/0173963 | A1 * | 6/2014 | Kent | F41A 21/26<br>42/90 |
| 2015/0253098 | A1 | 9/2015 | Russell et al. | |
| 2015/0323276 | A1 | 11/2015 | Myers et al. | |
| 2015/0354422 | A1 | 12/2015 | Liskey et al. | |
| 2016/0010935 | A1 | 1/2016 | Clarke et al. | |
| 2016/0010936 | A1 | 1/2016 | Moon | |
| 2016/0018179 | A1 * | 1/2016 | Morris | F41A 21/30<br>181/223 |
| 2016/0084602 | A1 | 3/2016 | Smith | |
| 2016/0123689 | A1 | 5/2016 | Maeda | |
| 2016/0161203 | A1 | 6/2016 | Wilson | |
| 2016/0209151 | A1 * | 7/2016 | Smith | F41A 21/30 |
| 2017/0191781 | A1 * | 7/2017 | Lau | F41A 21/30 |
| 2018/0031346 | A1 | 2/2018 | Washburn, III et al. | |
| 2018/0106569 | A1 * | 4/2018 | Smith | F41A 21/30 |
| 2018/0172383 | A1 | 6/2018 | James | |
| 2019/0063859 | A1 | 2/2019 | Gilpin | |
| 2019/0353447 | A1 * | 11/2019 | Palenik, II | F41A 21/36 |

* cited by examiner

THERMAL RESPIRATING SOUND SUPPRESSOR

CROSS-REFERENCE TO RELATED APPLICATIONS

This application claims priority to and is a continuation-in-part of U.S. application Ser. No. 16/102,093 filed by Gaines on Aug. 13, 2018 entitled THERMAL RESPIRATING SOUND SUPPRESSOR, which is a continuation-in-part of U.S. Provisional Application Ser. No. 62/544,307 filed by Gaines on Aug. 11, 2017 entitled THERMAL RESPIRATING SOUND SUPPRESSOR Both prior applications are incorporated by reference in its entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in firearm sound suppression. More particularly, the invention relates to improvements particularly suited for self cooling suppressors for automatic weapons. In particular, the present invention relates specifically to a mechanically air cooled suppressor.

2. Description of the Known Art

As will be appreciated by those skilled in the art, noise reduction for firearms is known in various forms. Patents disclosing information relevant to firearm noise reduction include: U.S. Pat. No. 9,671,188 issued to Sellars on Jun. 6, 2017 entitled Rifle accuracy and noise suppression systems; U.S. Pat. No. 9,115,949 issued to Morrison on Aug. 25, 20 entitled Coil-equipped firearm suppressor; U.S. Pat. No. 9,115,950 issued to Bethlenfalvy on Aug. 25, 20 entitled Firearm suppressor; U.S. Pat. No. 7,997,0 issued to Brixius on Aug. 16, 2011 entitled Gun barrel assembly; U.S. Pat. No. 9,714,805 issued to Lau on Jul. 25, 2017 entitled Compact space-saving gun silencer; U.S. Pat. No. 8,272,306 issued to Smith on Sep. 25, 2012 entitled Adjustable silencer booster with spoked piston engagement shoulder; and U.S. Pat. No. 3,952,629 issued to Boccarossa, et al. on Apr. 27, 1976 entitled Small arms silencer. Other patents teaching multiple spring systems include U.S. Pat. No. 4,210,060 issued to Donovan on Jul. 1, 1980 entitled Gas operated automatic weapon. Each of the aforementioned patents is hereby expressly incorporated by reference in their entirety.

Suppressors or silencers are well known in the art and are especially popular with hunters and sport shooters. As used herein the terms silencer and suppressor are interchangeable because the weapon system discussed herein may utilize more than one system in order to reduce the sound of a firearm. Usually sound suppression systems use a series of baffles, in various configurations, or a series of chambers, in order to reduce the expanding gas pressure of a controlled explosion. The introduction of a suppressor, to a firearm, greatly reduces the sound of a controlled explosion, in relation to its use on a firearm. The prior art of silencers and suppressors have suffered from thermal transference, and malfunctions in relation to the thermal dynamics associated with their use on firearms. Many suppressors cannot be used on fully automatic firearms due to gas pressure buildup within these systems, while in sustained operation. Typical malfunctions include; over pressurizing the suppressor tube, thermal regulation of the device, and the inability of the operator to service the overall device and its components after use.

Other items for consideration include the history of gunpowder. In 1884, Paul Vieille invented a smokeless powder called Poudre B (short for poudre blanche-white powder, as distinguished from black powder) made from 68.2% insoluble nitrocellulose, 29.8% soluble nitrocellulose gelatinized with ether and 2% paraffin. This was adopted for the Lebel rifle.

Nitrocellulose (also known as cellulose nitrate, flash paper, flash cotton, guncotton, and flash string) is a highly flammable compound formed by nitrating cellulose through exposure to nitric acid or another powerful nitrating agent. When used as a propellant or low-order explosive, it was originally known as guncotton.

Paraffin wax is a white or colourless soft solid, derived from petroleum, coal or oil shale, that consists of a mixture of hydrocarbon molecules containing between twenty and forty carbon atoms. It is solid at room temperature and begins to melt above approximately 37° C. (99° F.).

Ether is a pleasant-smelling, colorless, volatile liquid that is highly flammable. It is used as an anesthetic and as a solvent or intermediate in industrial processes.

Graphite is a gray, crystalline, allotropic form of carbon that occurs as a mineral in some rocks and can be made from coke. It is used as a solid lubricant, in pencils, and as a moderator in nuclear reactors.

Coke is a fuel with a high carbon content and few impurities, usually made from coal. It is the solid carbonaceous material derived from destructive distillation of low-ash, low-sulphur bituminous coal. Cokes made from coal are grey, hard, and porous. While coke can be formed naturally, the commonly used form is synthetic. The form known as petroleum coke, or pet coke, is derived from oil refinery coker units or other cracking processes. Coke is used in preparation of producer gas which is a mixture of carbon monoxide (CO) and nitrogen (N2).

From these prior references and information it may be seen that these prior art patents are very limited in their teaching and utilization, and an improved firearm noise suppressor is needed to overcome these limitations.

SUMMARY OF THE INVENTION

The present invention is directed to an improved suppressor using sound suppression and gas pressure reduction. A mechanical process which reduces thermal transference and cyclic blowback of a gas operated impingement system is also provided. This reduces the recoil and muzzle flash of a firearm as the hot gasses exit the device.

The present invention corrects for the over pressurizing of the suppressor tube using a gas pressure valve and release system; through the use of an expansion chamber with multiple gas regulating ports, having a specified number of ports with a specified diameter, in relation to the use with a various number of firearm cartridges. The present invention corrects for the overheating of the overall device using a thermal tube and pressure piston in conjunction with a spring loaded venting system. The present invention corrects for the inability of the operator to adequately service and maintain a typically closed system by including a simple build up design with threads such that this device is fully serviceable by the operator.

A primary object of the present invention is to provide a suppressor capable of regulating the thermal transference of a firearm, to a suppressor, in a semi-automatic or fully-automatic mode of fire.

It is a further object of the invention to provide a gas pressure regulating system in the field of firearm suppression.

A still further object is to provide a combination of principles in a singular device to provide sound suppression and thermal regulating properties in a single device.

The present invention provides a sound suppression device with added security against injury do to a high pressure gas malfunction, while also reducing the threat of injury due to physical contact burns, caused by the unregulated thermal transference to the suppressor from the firearm. The sound suppressor is comprised of seven basic parts including a gas pressure regulating section for providing the proper amount of pressurized gas into the thermal tube; a thermal tube, to collect thermal transference from the internal suppressor tube; a pressure piston to force the thermal buildup away from the suppressor tube; a guide spring to maintain proper alignment of the pressure piston within the thermal tube; a compression spring to return the pressure piston to the neutral position inside the thermal tube and accept the force of the expanding gasses from the gas pressure regulator; an internal suppressor tube, to maintain the alignment of its internal baffle system; and a thermal venting cap to secure the suppressor components together, while allowing the thermal buildup, inside the thermal tube, to be evacuated from the device.

A still further object is to provide a solution to the friction created as the Pressure Piston moves towards the distal end of the device, by creating a Graphite and Paraffin lubricant.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
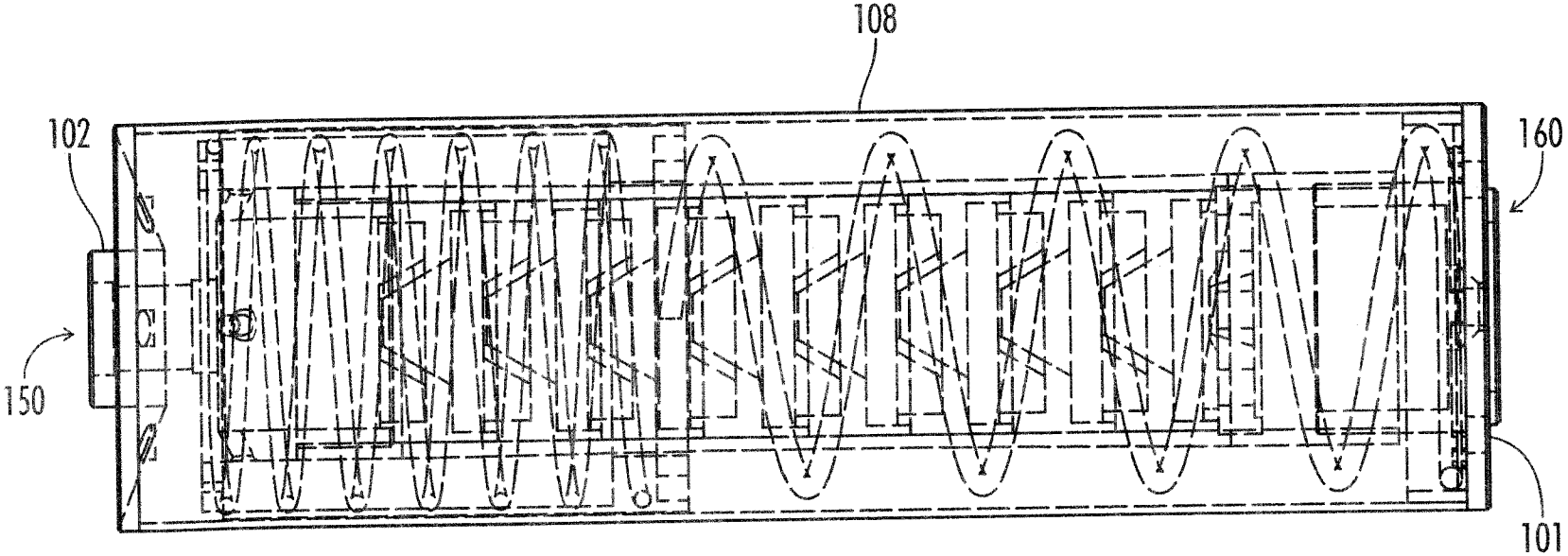
FIG. 1 is a schematic view of firearm noise reduction apparatus.
Figure 2:
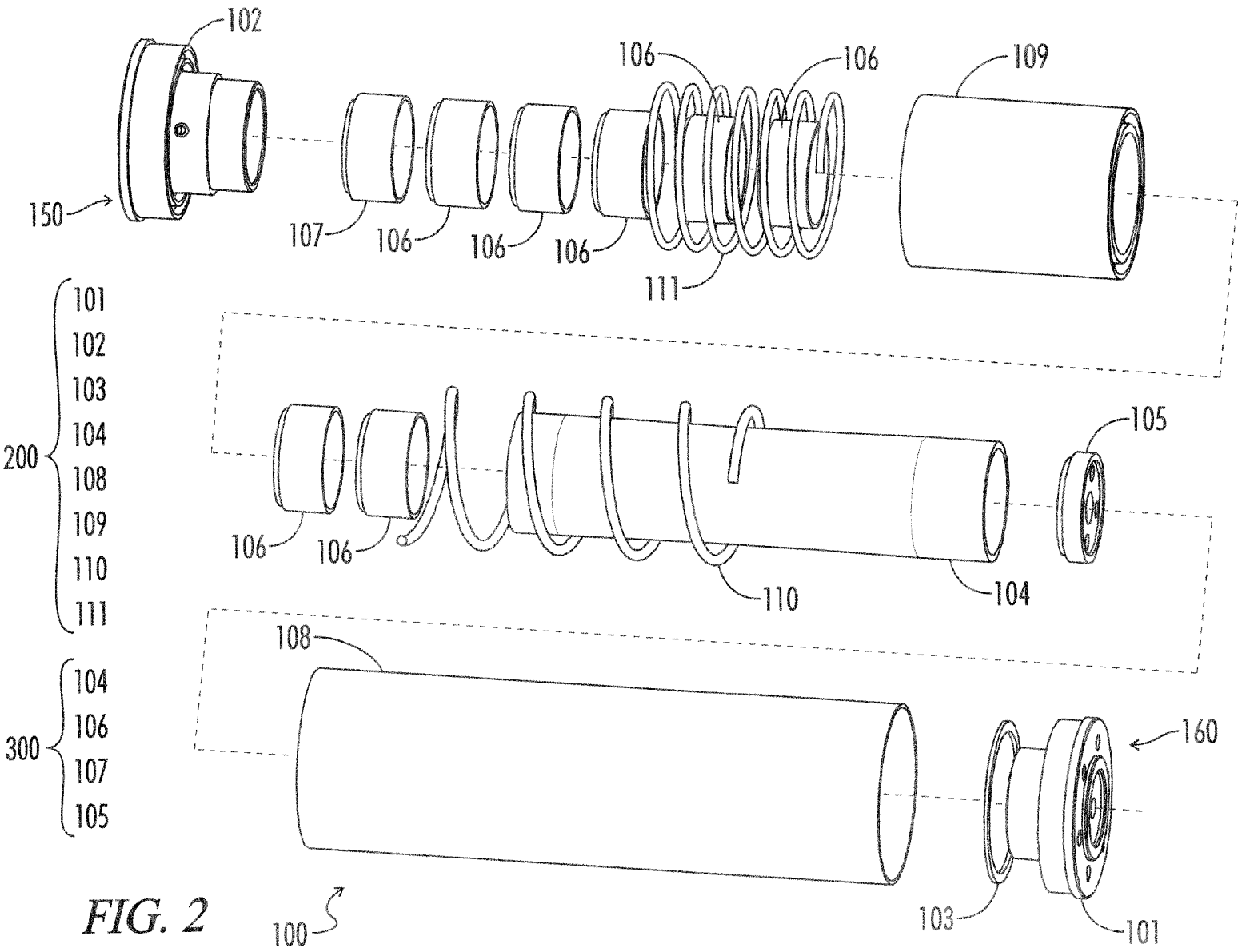
FIG. 2 is an exploded view thereof.
Figure 3:
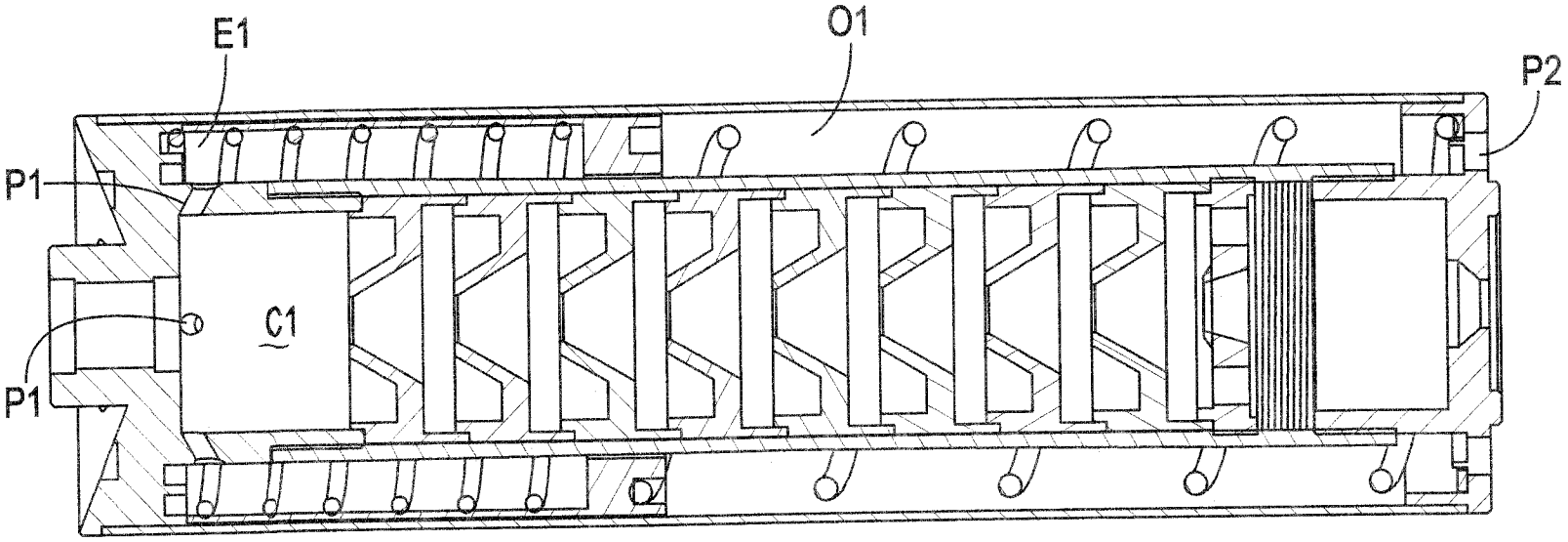
FIG. 3 is a cross sectional view thereof.
Figure 4C:
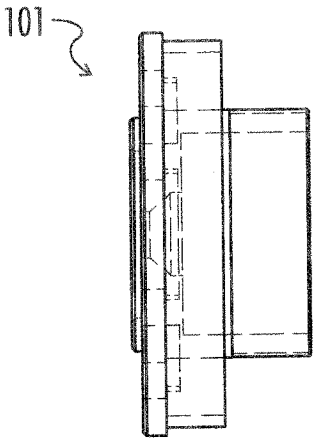
FIG. 4*c* is a partially transparent view thereof.
Figure 4A:
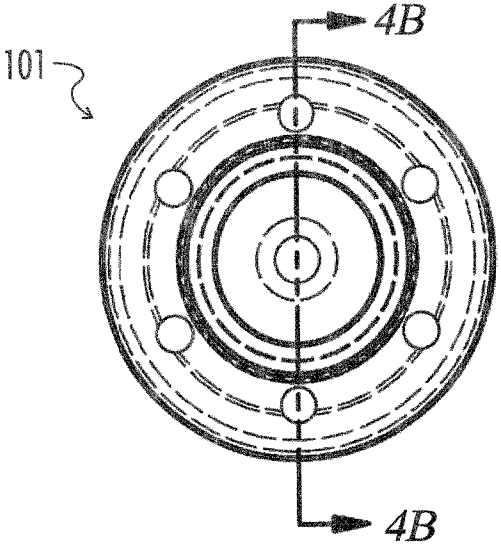
FIG. 4*a* is a distal end view of the thermal venting cap.
Figure 4D:
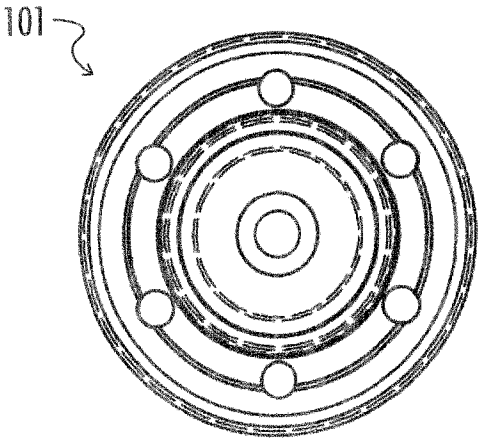
FIG. 4*d* is a proximate end view thereof.
Figure 4B:
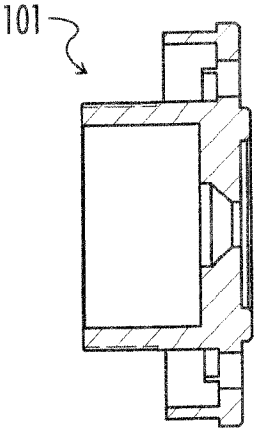
FIG. 4*b* is a sectional view thereof.
Figure 5D:
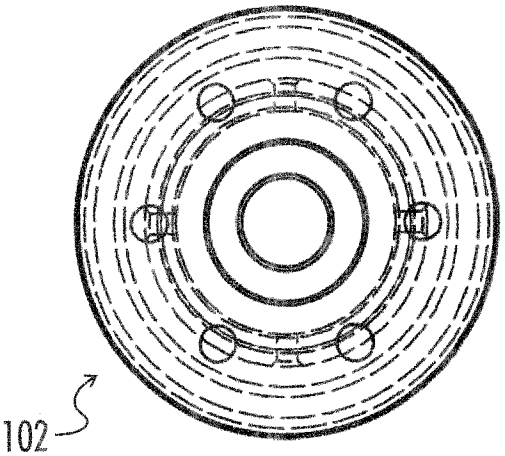
FIG. 5*d* is a proximate end view thereof.
Figure 5C:
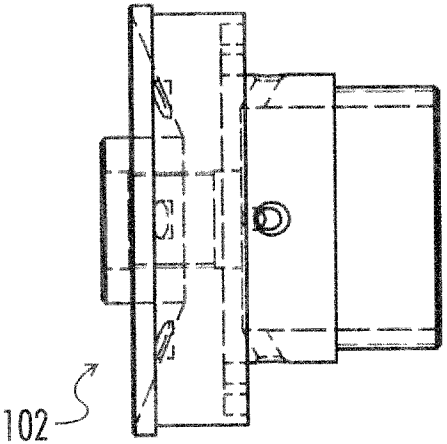
FIG. 5*c* is a partially transparent view thereof.
Figure 5A:
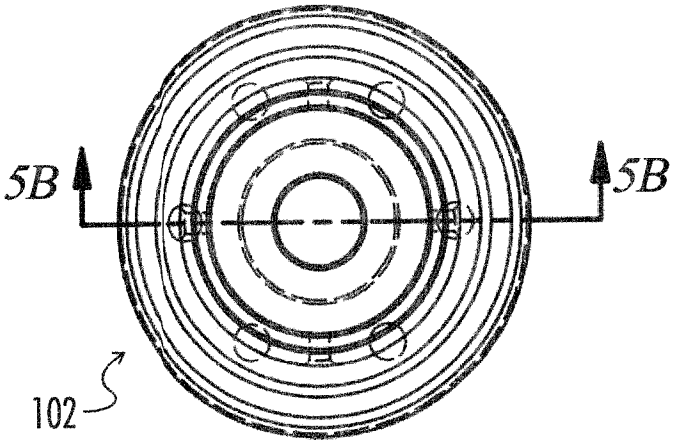
FIG. 5*a* is a distal end view of the gas pressure regulator.
Figure 5B:
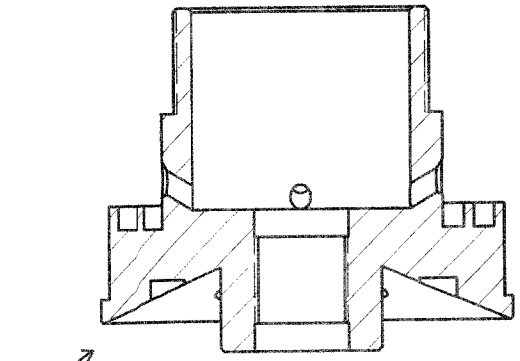
FIG. 5*b* is a sectional view thereof.
Figure 6B:
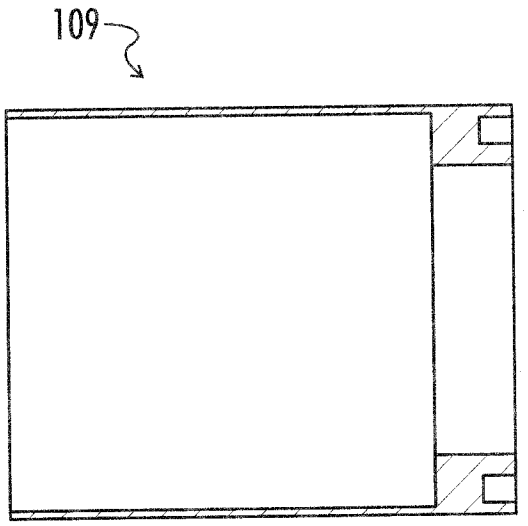
FIG. 6*b* is a sectional view thereof.
Figure 6A:
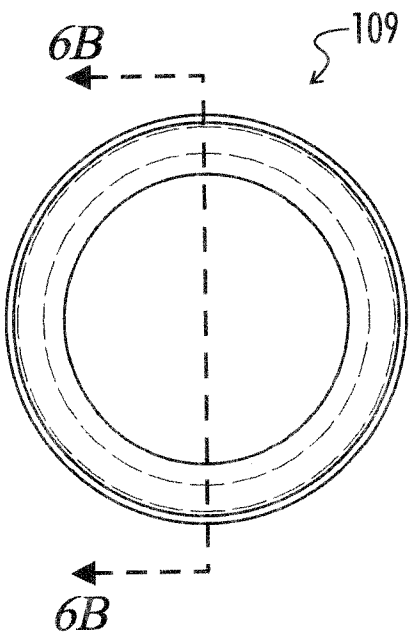
FIG. 6*a* is a distal end view of the pressure piston.
Figure 6C:
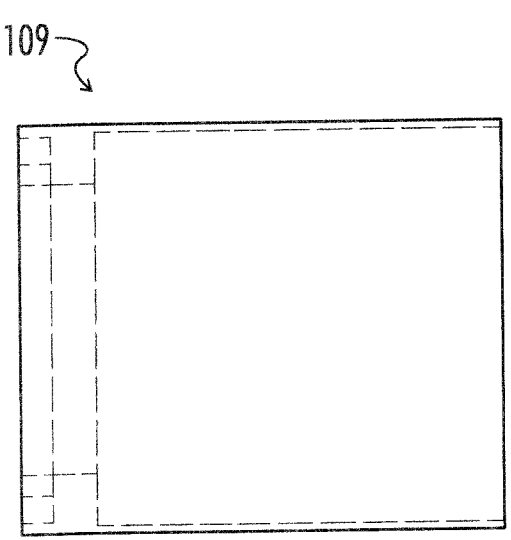
FIG. 6*c* is a partially transparent view thereof.
Figure 7:
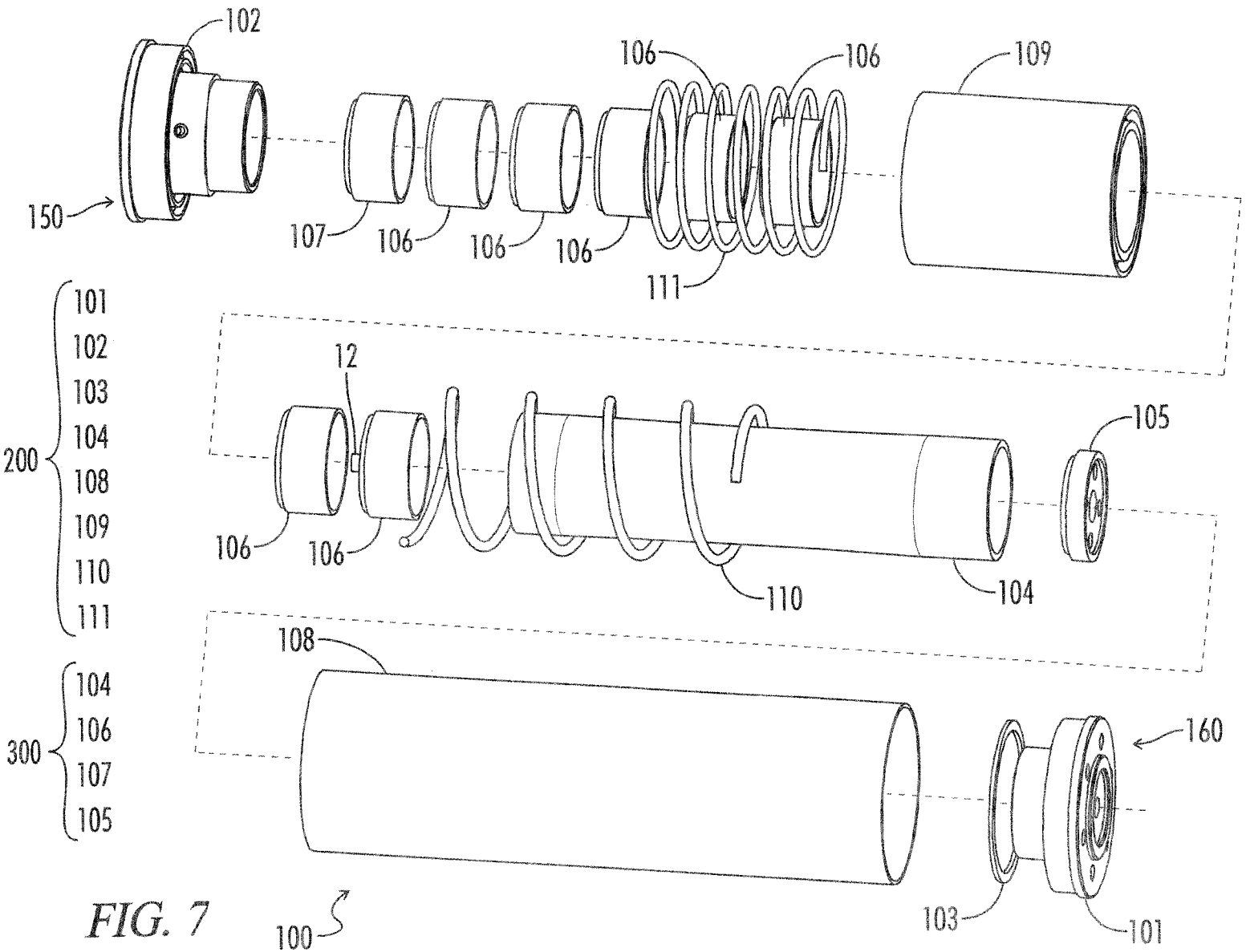
FIG. 7 is an exploded view of the firearm noise reduction apparatus.
Figure 8:
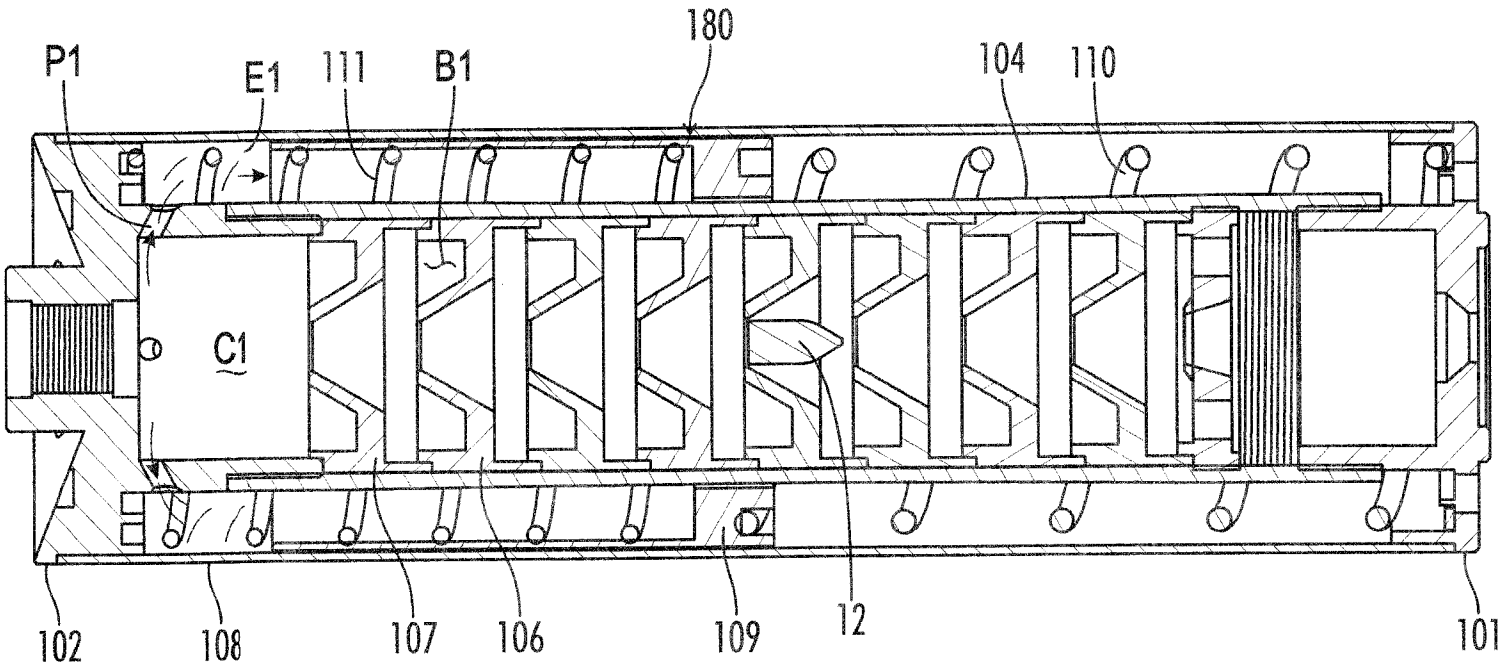
FIG. 8 shows an initial piston rest position with the bullet entering the device and gas pressure behind the bullet making contact with the piston.
Figure 9:
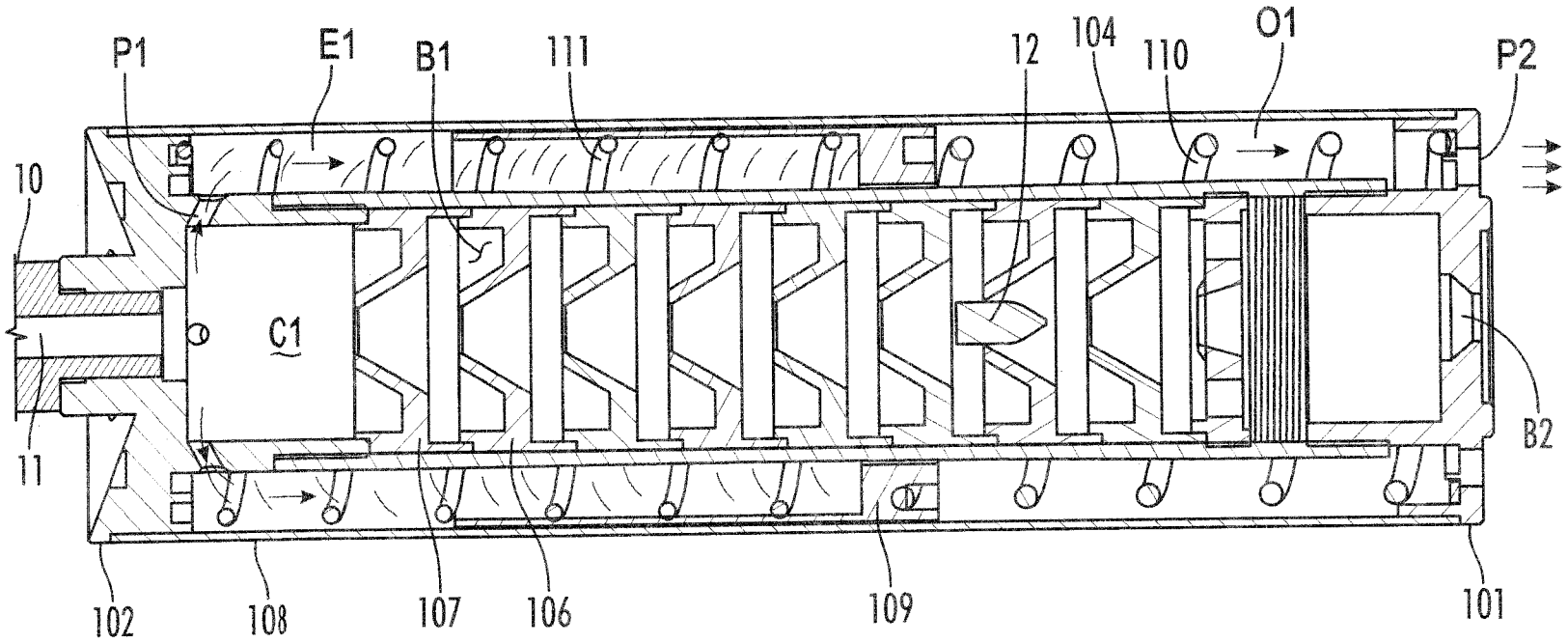
FIG. 9 shows the distal piston movement.

As shown in FIGS. 1 through 14 of the drawings, one exemplary embodiment of the present invention is generally shown as a firearm noise reduction apparatus 100 also referred to as a thermal respirating sound suppression system 100 or noise suppression device 100. For reference purposes, the proximate end 150 would be closest to the operator as it would be attached to the muzzle of a firearm while in operation and the distal end 160 of the device that would be furthest from the operator and the firearm.

As best understood from FIGS. 1 through 14, the thermal respirating sound suppression system 100 includes a thermal respirator 200 and a sound suppressor 300.

The thermal respirator 200 includes the thermal vent cap 101, the gas pressure regulator 102, the spring washer 103, the suppressor tube 104, the thermal tube 108; the pressure piston 109, the compression spring 110; and the guide spring 111.

The sound suppressor 300 includes the suppressor tube 104, the intermediate baffles 106, the master baffle 107, and the baffle lock 105.

The thermal venting cap 101 allows the evacuation through airflow using outside air port P2 which exhausts thermal buildup within the thermal tube 108 while interlocking the thermal respirator 200 and a sound suppressor 300 together. The thermal venting cap 101 is positioned at the distal end of the device 100.

The gas pressure regulator 102 includes regulator chamber C1 and regulator ports PI that regulate through their positioning and size the amount of pressurized gas that is allowed into the expansion chamber E1 defined by the gas pressure regulator 102, the suppressor tube 104, the thermal tube 108, and the pressure piston 109. By varying the number of directionally angled ports PI and controlling the diameter of the ports one can customize the gas pressure regulator 102 to the controlled explosion of a particular handgun or rifle cartridge. In the preferred embodiment, the ports are sized to absorb approximately fifty percent of the initial gas pressure with the pressure piston 109.

The spring washer 103 is simply provided to allow for a friction relief between the compression spring and the thermal vent cap 101 to allow for easy disassembly of the device 100.

The suppressor tube 104 screws into place between the gas pressure regulator 102 and contains the baffle lock 105 to contain the intermediate baffles 106 and the master baffle 107. The thermal tube 108 screws into position between the gas pressure regulator 102 and the thermal vent cap 101 to hold the pressure piston 109 and the springs 110, and 111.

The pressure piston 109 is vital in the evacuation of thermal gasses and the subsequent intake of and outside air into the device 100. The pressure piston 109 moves between a proximate position 170, a neutral position 180, and a distal position 190. The pressure piston is in the neutral position 180 during non operation, and moves to the distal position 190 when exposed to pressure from the barrel and then cycles to the proximate position 170 before returning to the neutral position 180.

The compression spring 110 is designed to control the travel distance of the pressure piston 109 inside the thermal tube 108, and control the pressure piston 109 return speed to its neutral position inside the thermal tube 108. The compression spring 1 is what allows the device to be used with a weapon in a fully-automatic firing mode.

The guide spring 111 stabilizes and guides the pressure piston 109 over the suppressor tube 104 down the length of the thermal tube 108.

The elements includes Regulator port P1, Regulator chamber C1, Expansion chamber E1, Outside air chamber O1, Outside port P2, Baffle expansion chamber B1, and Bore aperture B2.

As shown in FIGS. 9 through 12, operation of the device 100 uses the pressure generated in the bore 11 of a firearm barrel for firing a bullet 12 to move the pressure piston 109 to provide mechanical cooling of the device 100. When the device 100 is attached to a firearm barrel and the firearm is discharged; the projectile or bullet 12 of the firearm, accompanied by an ever-expanding volume of hot gas, exits the barrel bore 11 of the firearm into the gas pressure regulator 102 at regulator chamber C1. As the hot gasses enter the expansion chamber C1 the gas is vented through a specified number of gas ports P1 into the expansion chamber E1 in the thermal tube 108, pressurizing the proximate end of the pressure piston 109. As the pressure of the hot gas venting through the port P1 of the gas pressure regulator 102 increases, the pressure piston 109 is forced down the thermal tube 108, simultaneously evacuating the outside air chamber O1 and any hot air trapped inside the thermal tube 108 from the previous discharge of the firearm. While this function is taking place, the guide spring 111 expands and guides the pressure piston 109 over the suppressor tube 104, compressing the compression spring 110. As the pressure inside the thermal tube 108 reaches its maximum pressure rating, determined by the tension of the compression spring 110, the remainder of the gas inside the chamber C1 of the gas pressure regulator 102 is evacuated through the baffle expansion chambers B1 in the baffles 106, 107 inside the suppressor tube 104.

Figure 10:
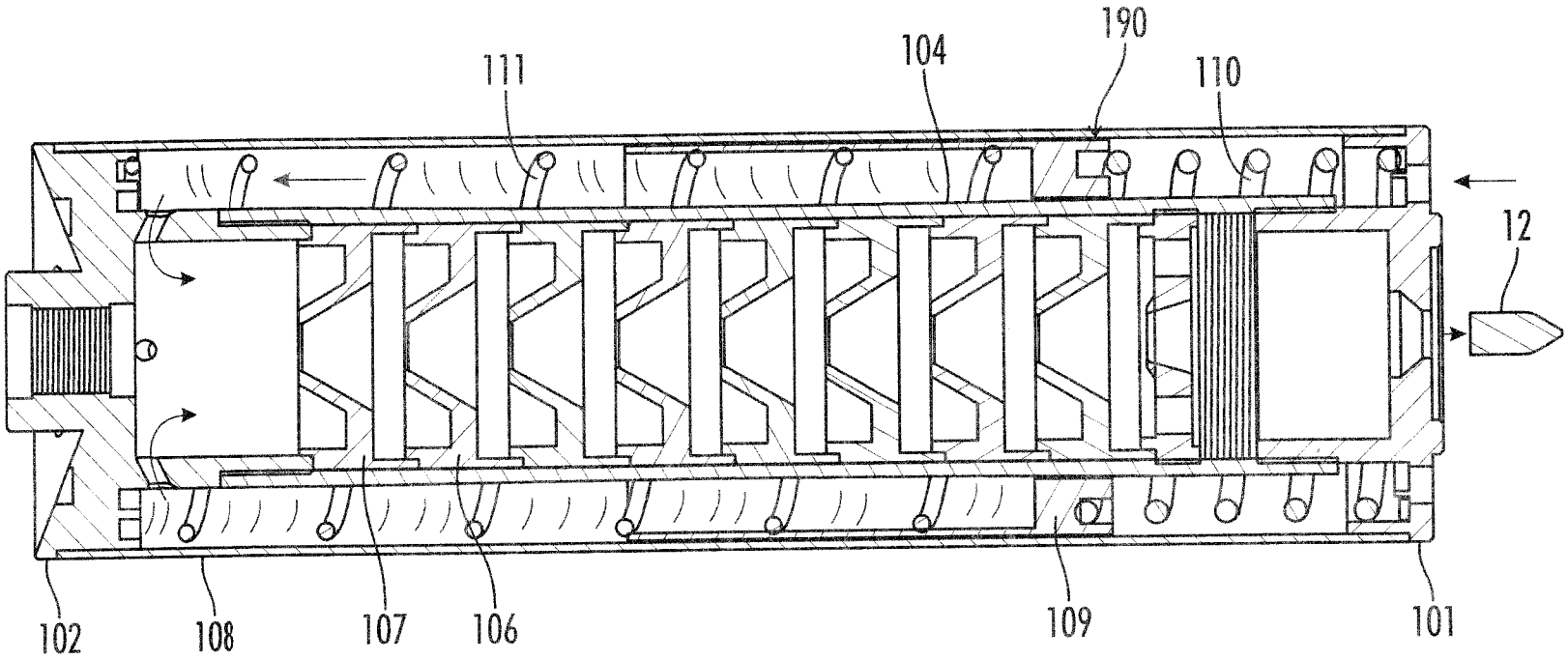
FIG. 10 shows additional distal piston movement to an extended distal position.
Figure 11:
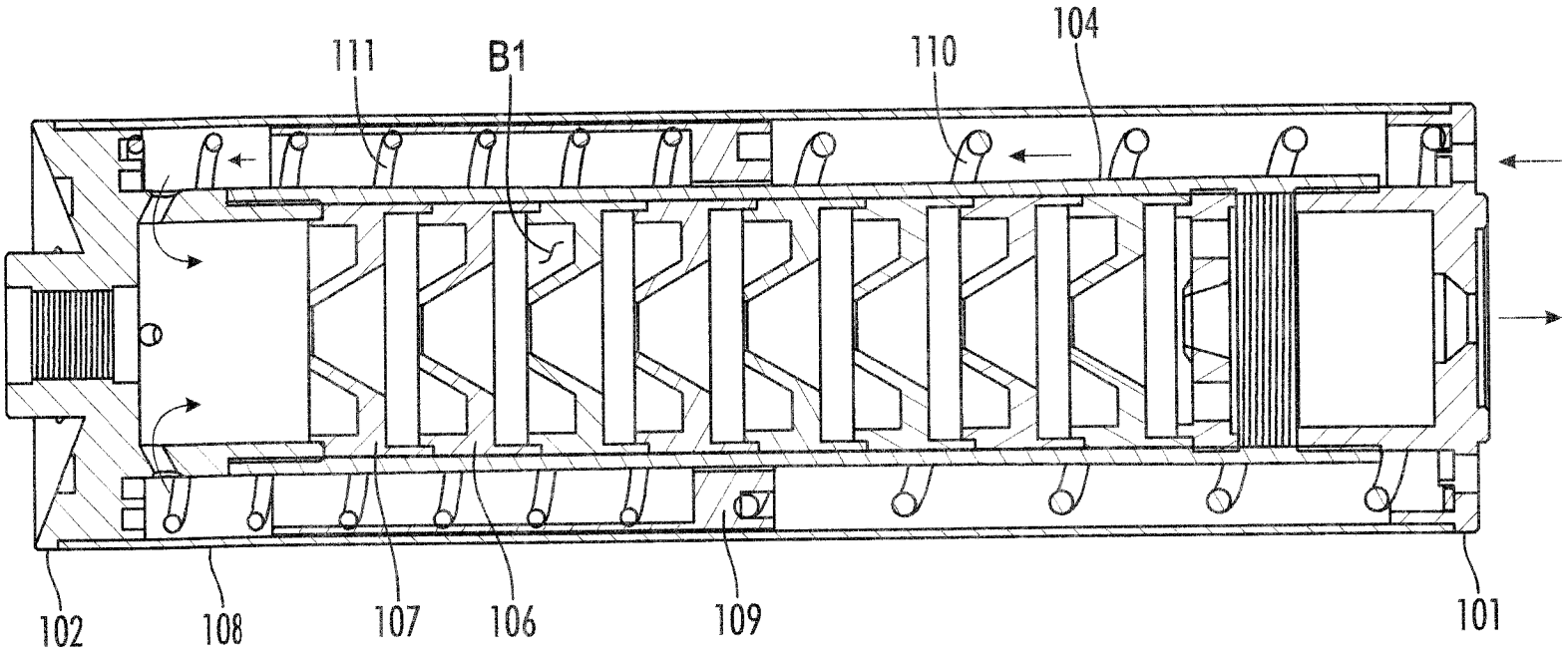
FIG. 11 shows proximate piston movement.
Figure 12:
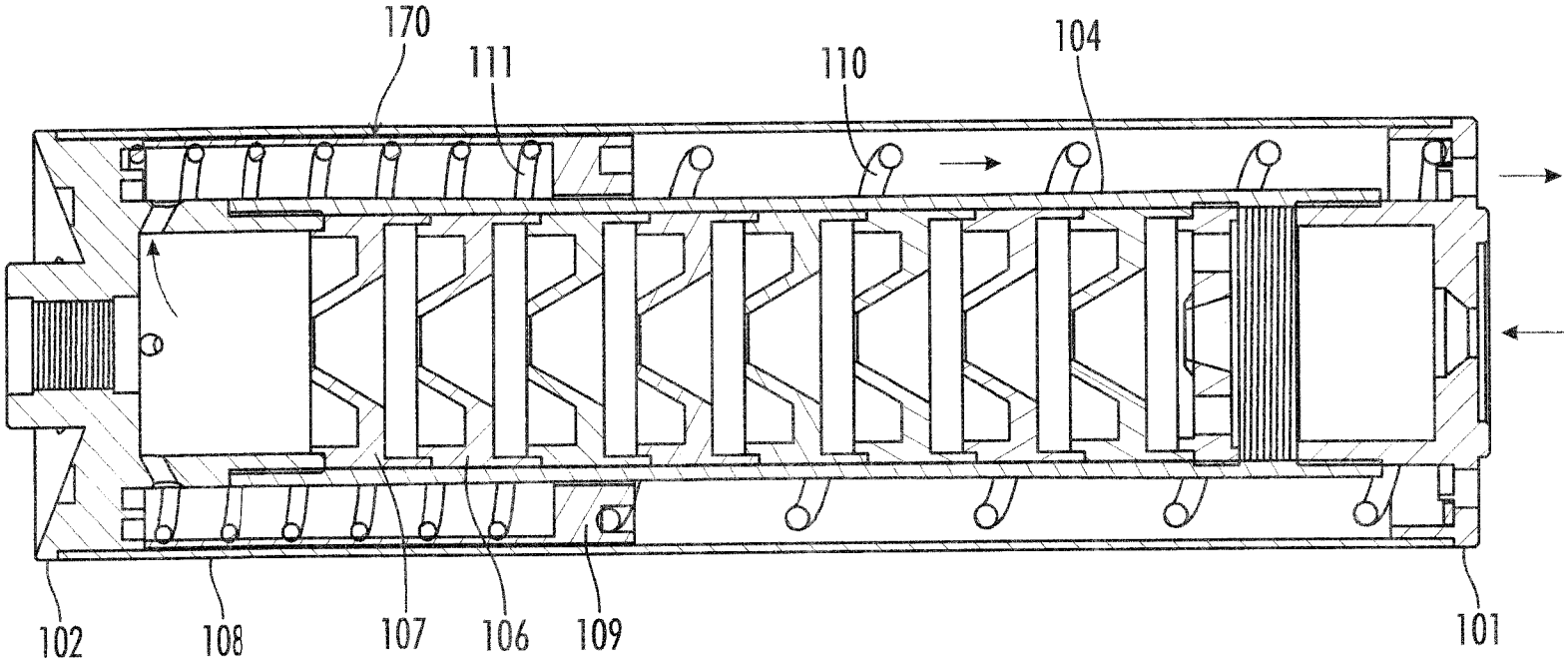
FIG. 12 shows additional proximate piston movement to a retracted proximate position.
Figure 13:
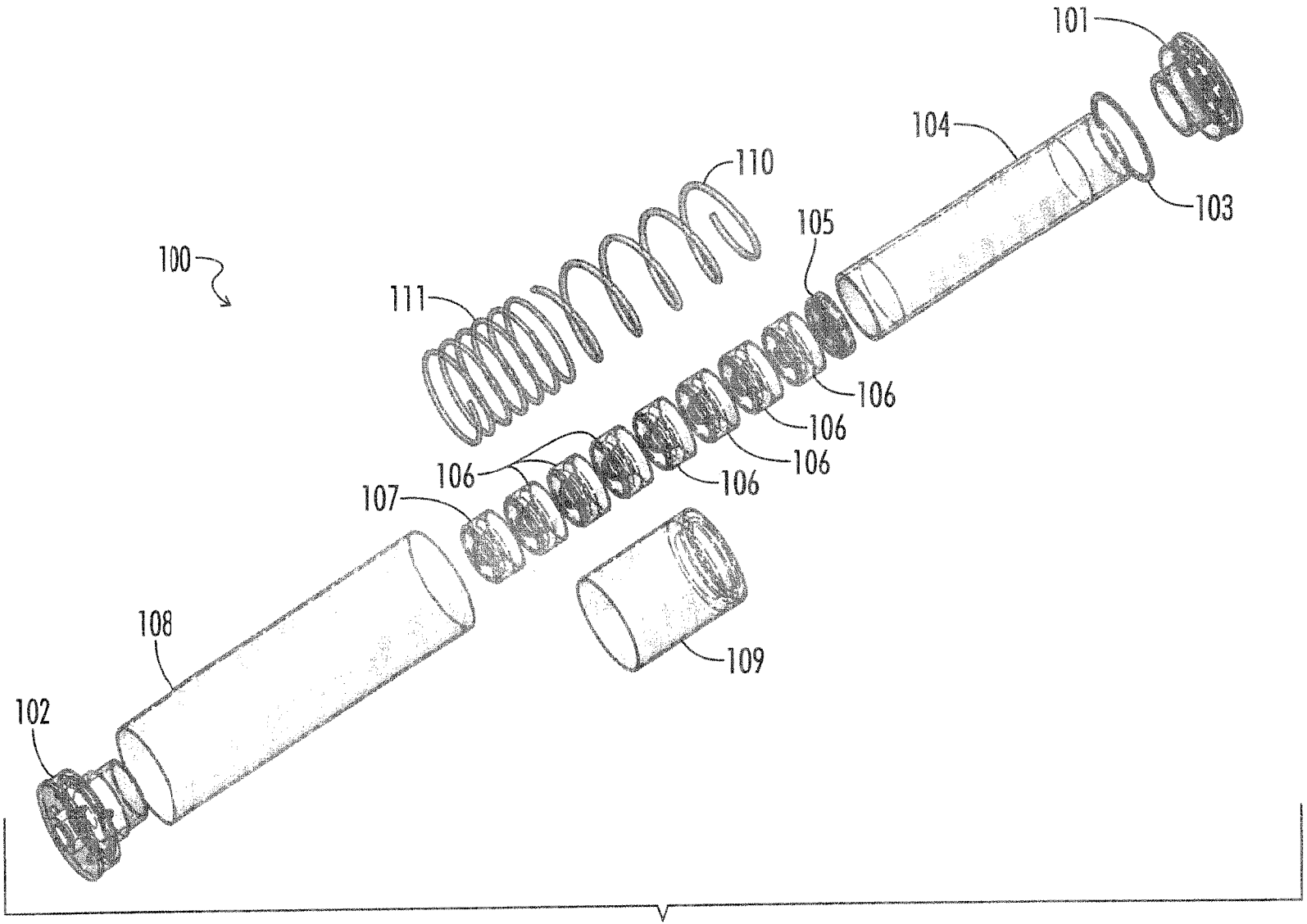
FIG. 13 shows a transparent exploded view for additional consideration.
Figure 14:
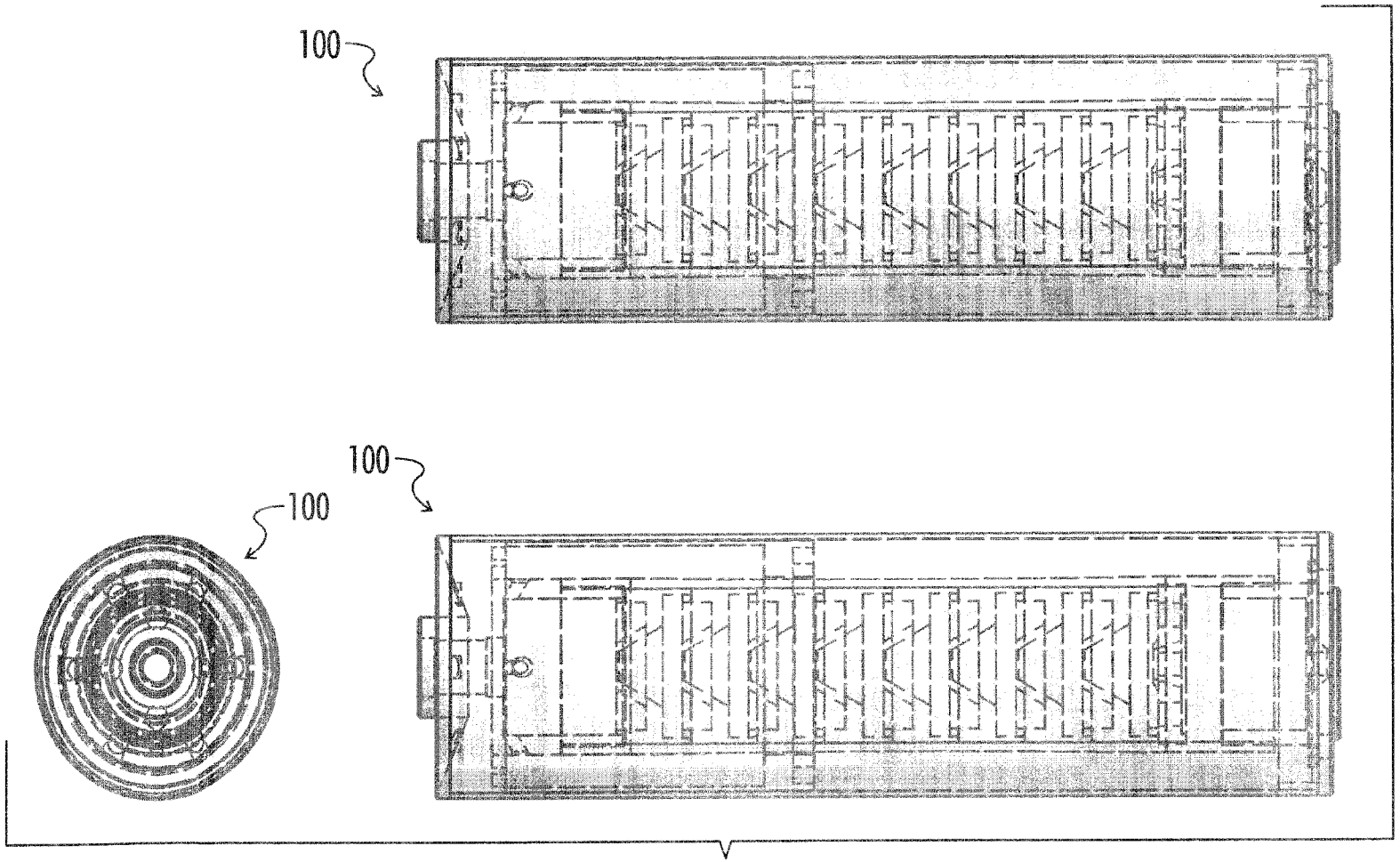
FIG. 14 shows a transparent view without the springs to allow show the piston and baffle positioning.

Beginning with FIG. 10 and continuing through FIGS. 11 and 12, once the bullet 12 exists and the pressure inside the suppressor tube 14 and baffles 106, 107 decreases, the compression spring 110 can then return the pressure piston 109 through the proximate position 170 to its neutral position 180. As the pressure piston 109 returns down the thermal tube 108 towards it's neutral position 180, it draws outside air through the outside port P2 in the thermal vent cap 101 into the thermal tube 108 and simultaneously pushes the original hot gasses in the expansion chamber E1 back through the regulator port PI located in the gas pressure regulator 102 into its expansion chamber C1, and down the inside of the suppressor tube 104 and baffles 106, 107 and out the bore B2 and the distal end 190 of the device 100. Once the secondary gas has exited the suppressor tube 104, through the baffles 106, 107, the compression spring 110 and guide spring 111 balance to move the pressure piston back to the neutral position 180 inside the thermal tube 108 which draws outside air into the device 100 through port P2 to cool the device. The system 100 will now be ready for this mechanical process to be repeated.

In this process we use the Pressure Regulator to confine the three basic ingredients of White Powder/Gunpowder. As the muzzle blast enters the Pressure Regulator 102, the hot gasses are pressurized in a confined volume inside the expansion chamber E1. These gasses consist of three basic components, 68.2% insoluble nitrocellulose, 29.8% soluble nitrocellulose gelatinized with ether and 2% paraffin. Under the extreme pressure and heat generated by this process, the carbon is transformed into a low-grade graphite. The paraffin does not burn away and is then infused to the graphite, creating a physical bond of these two components. This lubricant is then injected, through the pressure release vents located in the Gas Pressure Regulator 102 and into the Thermal Tube 108, lubricating the Pressure Piston 109. Once injected into the Thermal Tube 108, the Graphite/Paraffin lubricant, coats the internal portion of the Thermal Tube 108 and the external portion of the Suppressor Tube 104. The lubricant also acts as a pressure seal, preventing the gasses trapped behind the Pressure Piston 109 from escaping.

Note also that this device 100 could be customized with relation to its ability to be utilized on a handgun or rifle platform. Items for customization include but are not limited to the size, weight, pressure rating, and port sizes of the gas pressure regulator and the thermal vent cap, and the compression and guide spring tension components of this device 100.

Reference numerals used throughout the detailed description and the drawings correspond to the following elements:

firearm barrel 10
barrel bore 11
thermal respirating sound suppression system 100
thermal vent cap 101
gas pressure regulator 102
spring washer 103
suppressor tube 104
baffle lock 105
intermediate baffles 106
master baffle 107
thermal tube 108
pressure piston 109
compression spring 110
guide spring 111
proximate end 150
distal end 160
proximate position 170
neutral position 180
distal position 190
thermal respirator 200
sound suppressor 300
Regulator port P1
Barrel chamber C1
Expansion chamber E1
Outside air chamber O1

Outside port P2

Bore aperture B1

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. A noise reduction apparatus for use with a firearm using above atmospheric gas pressure at an above atmospheric gas temperature to launch a bullet through a barrel defining a bore, the apparatus comprising:

a thermal respirator defining a proximate end and a distal end, the thermal respirator including a thermal tube and a thermal vent cap positioned at the distal end defining both a bore aperture for discharge of the bullet and an outside air port on the distal end of the respirator; and a sound suppressor including a stationary suppressor tube mounted within the thermal tube, and a pressure piston mounted between the thermal tube and the suppressor tube, the pressure piston defining an expansion chamber and an outside air chamber within the thermal tube, the pressure piston moving independently from both the thermal tube and the suppressor tube.

2. The apparatus of claim 1, the thermal respirator further comprising:

the thermal vent cap connected to the thermal tube;

a compression spring mounted inside the outside air chamber;

a guide spring mounted inside the expansion chamber; and a gas pressure regulator flowably connected to the bore aperture and the expansion chamber.

3. The apparatus of claim 1, the sound suppressor further comprising:

removable baffles secured inside the suppressor tube.

4. A noise reduction apparatus for use with a firearm using above atmospheric gas pressure at an above atmospheric gas temperature to launch a bullet through a barrel defining a bore, the apparatus comprising:

a thermal tube defining both a proximate end and a distal end, the thermal tube further defining a bore aperture and an outside air port on the distal end of the thermal tube;

a suppressor tube mounted inside the thermal tube;

a pressure piston mounted between the thermal tube and the suppressor tube defining an expansion chamber and an outside air chamber within the thermal tube;

the pressure piston moving independently from both the thermal tube and the suppressor tube;

a compression spring mounted inside the outside air chamber;

a guide spring mounted inside the expansion chamber;

a gas pressure regulator flowably connected to the bore aperture and the expansion chamber;

the pressure piston movable between a proximate position, a neutral position, and a distal position related to the gas pressure regulator.

5. The apparatus of claim 4, further comprising:

the gas pressure regulator including a regulator chamber and regulator ports passing the above atmospheric gas pressure into the expansion chamber to move the pressure piston from the neutral position to the distal position by compressing the compression spring, the compression spring subsequently moving the pressure piston back to the neutral position.

6. The apparatus of claim 4, further comprising:

at least one baffle mounted inside the suppressor tube.

7. The apparatus of claim 6, further comprising:

a baffle lock removably securing the at least one baffle inside the suppressor tube.

8. The apparatus of claim 4, further comprising:

a thermal vent cap connected to the thermal tube.

* * * * *